US009677196B2

(12) United States Patent
Rovellini

(10) Patent No.: US 9,677,196 B2
(45) Date of Patent: Jun. 13, 2017

(54) PROCESS FOR MANUFACTURING CARBON FIBERS

(75) Inventor: Marco Rovellini, Piacenza (IT)

(73) Assignee: M.A.E. S.P.A., Piacenza (IT)

( * ) Notice: Subject to any disclaimer, the term of this patent is extended or adjusted under 35 U.S.C. 154(b) by 425 days.

(21) Appl. No.: 14/234,261

(22) PCT Filed: Jul. 17, 2012

(86) PCT No.: PCT/IB2012/053641

§ 371 (c)(1),
(2), (4) Date: Jan. 22, 2014

(87) PCT Pub. No.: WO2013/014576

PCT Pub. Date: Jan. 31, 2013

(65) Prior Publication Data

US 2014/0151914 A1 Jun. 5, 2014

(30) Foreign Application Priority Data

Jul. 22, 2011 (IT) ..... M12011A1372

(51) Int. Cl.
*C01B 31/02* (2006.01)
*D01D 5/04* (2006.01)
(Continued)

(52) U.S. Cl.
CPC ..... *D01F 9/22* (2013.01); *D01D 5/16* (2013.01); *D01D 10/0454* (2013.01);
(Continued)

(58) Field of Classification Search
CPC . C01B 31/02; D01D 5/04; D01D 5/06; D01D 5/16; D01D 7/00; D01D 10/0454;
(Continued)

(56) References Cited

U.S. PATENT DOCUMENTS 2,249,797 A * 7/1941 Torrence ..... D01D 10/0454 425/67
3,006,027 A * 10/1961 Hildebrandt ..... D01D 5/06 264/196

(Continued)

FOREIGN PATENT DOCUMENTS

EP 2264232 12/2010
JP 51082025 A * 7/1976 ..... D01F 9/14

OTHER PUBLICATIONS

International Search Report, Dated Nov. 26, 2012, in PCT/IB2012/053641.

*Primary Examiner* — Leo B Tentoni
(74) *Attorney, Agent, or Firm* — Young & Thompson

(57) ABSTRACT

Process for manufacturing carbon fibers, includes a first spinning step of a fiber of PAN precursor and a second oxidation/carbonization step of the fiber and the plant thereof. The spinning and oxidation/carbonization steps are performed directly in line and continuously, and hence without any stocking buffer area of a PAN precursor between the two steps. The spinning step is performed at low speed, so that the output speed from the spinning step, downstream of the stretching operations, is a speed falling within the range of the suitable processing speeds in the subsequent oxidation/carbonization step. Moreover, the spinning step is performed in a modular way on a plurality of spinning modules aligned in one or more rows, each spinning module having a productivity not above 10% of the overall productivity of the spinning step. In any individual spinning module, the fibers downstream of the spinning area follow zig-zag, rectilinear paths.

8 Claims, 4 Drawing Sheets

(51) Int. Cl.

| | |
|---|---|
| ***D01D 5/06*** | (2006.01) |
| ***D01D 7/00*** | (2006.01) |
| ***D01F 9/22*** | (2006.01) |
| ***D01D 10/04*** | (2006.01) |
| ***D01F 9/32*** | (2006.01) |
| ***D01D 5/16*** | (2006.01) |
| ***D01D 13/02*** | (2006.01) |

(52) U.S. Cl.
CPC ..... *D01D 10/0481* (2013.01); *D01D 13/02* (2013.01); *D01F 9/225* (2013.01); *D01F 9/32* (2013.01); *D01F 9/328* (2013.01)

(58) Field of Classification Search
CPC ..... D01D 10/0481; D01F 9/22; D01F 9/225; D01F 9/328
USPC ..... 264/29.1, 29.2, 29.5, 29.6, 29.7, 182, 264/206, 210.5, 210.7, 210.8, 211.12, 264/211.14, 211.15, 211.17, 233; 423/447.1, 447.2, 447.7, 447.8
See application file for complete search history.

(56) References Cited

U.S. PATENT DOCUMENTS

| | | | | | |
|---|---|---|---|---|---|
| 3,775,520 | A | | 11/1973 | Ram et al. | |
| 4,069,297 | A | | 1/1978 | Saito et al. | |
| RE30,414 | E | * | 10/1980 | Kinoshita | D01F 9/22 264/29.2 |
| 4,613,470 | A | * | 9/1986 | Aftalion | D01D 5/20 264/210.8 X |
| 4,895,712 | A | * | 1/1990 | Komine | D01F 9/155 264/29.2 |

* cited by examiner

PROCESS FOR MANUFACTURING CARBON FIBERS

The present invention refers to an improved process for manufacturing carbon fibres.

BACKGROUND OF THE INVENTION

Carbon fibres (CF)—discovered for the first time by Edison in 1879 upon the carbonisation of a cotton thread, while searching for a filament suitable for incandescent lamps—appeared on the market only in 1960 through a manufacturing process devised by William Watt for the Royal Aircraft in the UK starting from the transformation of a polyacrylonitrile fibre (PAN).

Carbon fibres consist of thin filaments, continuous or of predetermined length (staple fiber), having a diameter of 5-10 μm, consisting mainly of carbon atoms. Carbon atoms are mutually bonded in a crystal matrix, wherein the individual crystals are aligned, to a smaller or larger extent, along the longitudinal axis of the fibre, thus imparting to the fibre an extraordinarily high resistance compared to the size thereof.

Various thousands of carbon fibres are then mutually gathered to form a thread or a tow (or roving) which can then be used as it is or woven in a loom to form a fabric. The yarn or fabric thus obtained are impregnated with resins, typically epoxy resins, and then moulded to obtain composite products characterised by high lightness and resistance.

Carbon fibres represent the transition point between organic and inorganic fibres; as a matter of fact, they are produced starting from organic fibres which are modified by thermal treatments and pyrolysis, during which first a reorientation of the molecular segments within the individual fibres is caused and subsequently, at higher temperatures, the removal of oxygen, hydrogen and of most of the nitrogen occurs, so that the final fibre consists to over 90% and up to 99% of carbon and for the rest of nitrogen.

Together with the availability of glass fibres, the availability on the market of carbon fibres has given rise to the use of composite materials to an ever growing extent. With the use of carbon fibres, in particular, it has been possible to devise composite materials having advanced mechanical performances for uses initially for the military and/or aeronautic sectors, considering the high cost of this material, and later—with the improvement of the manufacturing techniques and resulting cost reduction—also for the products of the energy industry (pressurised tanks, wind generator blades, fuel batteries, off-shore platforms), of the transport industry (trains, cars, boats) and of the leisure industry (tools and equipment for practising sports). While for this last application sector already today the market appears fully developed, in the aeronautical sector, and especially in the industrial sector, in the next 5-year period a sharp demand increase is expected and hence the need to extend the existing pool of manufacturing plants.

Carbon fibres are currently manufactured by modification of artificial fibres (rayon industrially, lignin experimentally) or synthetic fibres (polyacrylonitrile for at least 90% of the world output, but also PBO and experimentally other thermoplastic fibres) or of residues of the distillation of oil or tar (pitch). The first ones are traditionally called PAN-derived carbon fibres, while the second ones are called pitch-derived carbon fibres. This last type of fibres is often improperly referred to as "graphite fibres", even though of course they are not fibres obtained from graphite, to stress the fact that when such fibres undergo a thermal treatment above 2000° C., they finally exhibit a carbon atom arrangement very similar to that typical of graphite and a substantial absence of other elements in the reticule.

In the case of PAN-derived carbon fibres, a sector in which the present invention is set, the starting polyacrylonitrile fibre (the so-called precursor) must be characterised by a suitable chemical composition, by a special molecular orientation and by a specific morphology, so that a final carbon fibre with satisfactory features may be obtained from the same. The chemical composition is important also for the purpose of controlling the exothermic level of the cyclisation reaction of the —CN, equal to 18 kcal/mole, a reaction which represents the first processing step of the polyacrylonitrile fibre. In the textile-derived plants, the precursor is typically mass-produced and the individual fibres are collected in bundles or tows containing up to 300,000 individual filaments; the smaller tows produced in this type of plants contain for example 48,000 filaments (so-called 48K). At the same time, plants exist which were devised specifically for manufacturing low-denier tows, where production occurs on a small or medium scale with the manufacture of tows of 1K, 3K, 6K and 12K. In this case the individual tows can be mutually gathered to form larger ones, for example 24K or 48K tows, at the end of the carbonisation process. The carbon fibres produced in the first type of plants have a lower manufacturing cost, given by the high productive capacity of the same, but they have a smaller degree of regularity, and they are hence better suited for industrial uses. The carbon fibres produced in the second type of plants are instead more regular and more appreciated by the aeronautical industry, where there is already a consolidated habit of using smaller carbon fibre tows.

The cyclisation reaction of the PAN fibres represents, as stated above, the first step of the carbonisation process. It is conducted in air, at 200-295° C. (220-275° C. in current practice) for a few hours, and leads to a black, fireproof material, the so-called oxidised PAN, which exhibits rather poor mechanical properties and is meant—as it is—for the production of protective clothing, fireproof padding or, in carbon-carbon composites, of heavy-duty brakes (for aircrafts, racing cars and high-speed trains).

During the cyclisation step at 200-295° C. it is very important to check for fibre retraction, since in this step the alignment of molecular segments along the fibre axis is determined, on which orientation the final elastic modulus of the carbon fibre depends. The molecular orientation imparted to the original acrylic fibre affects the toughness and the elastic modulus of the final carbon fibre; however, the orientation degree must not be excessively high because in this case defects are introduced, both superficially and within the fibre.

The PAN fibre thus oxidised hence undergoes a subsequent carbonisation process, generally conducted in an inert atmosphere, during which the removal of foreign atoms from the carbon structure occurs with the development of the final graphite structure. The carbonisation process generally occurs in two steps: a first low-temperature step (350-950° C., 400-900° C. in current practice) and a second, high-temperature step (1000-1800° C., 1000-1450° C. in current practice). During all the steps of the carbonisation process hence HCN, $NH_3$ and $N_2$ develop and CO, $CO_2$ and $H_2O$ may also develop depending on the amount of $O_2$ that the PAN fibre has bound during the cyclisation at 200-295° C. in air. After the thermal treatment at over 1000° C. the PAN fibre has turned into a carbon fibre containing about 95% of carbon and 5% of nitrogen. During the carbonisation process the fibre is subject to a transversal shrinking which implies a diameter reduction with loss of about 50% of the initial weight thereof; the corresponding longitudinal shrinking is instead nearly fully mechanically hindered, with the corresponding development of a greater molecular orientation which contributes to the improvement of mechanical properties.

Downstream of this process a further pyrolysis treatment may be provided at temperatures ranging between 2000 and 2600° C., of course always in the absence of reactive gases, which takes the name of graphitisation process, during which the residual nitrogen percentage is expelled and the carbon contents of the fibres rise to over 99%. The carbon fibres which have undergone this further treatment exhibit even better mechanical properties, however at much higher costs, and are hence reserved to special uses.

At the end of the carbonisation process, the carbon fibres undergo a cleaning surface treatment and a treatment for attaching functional groups, for the purpose of easing the adhesion of the fibres to the resin matrix in the subsequent forming of composite materials; for this purpose many manufacturers use an electrolytic oxidation process. Finally, on the fibre thus treated, a sizing or finish is applied, for the purpose of minimising the damage deriving from the winding into the bobbin and to further improve fibre adhesion to the resin matrix into which it is meant to be embedded.

State of the Prior Art

Carbon fibres are currently produced according to a 2-step process scheme, wherein said steps are fully separate from one another. As a matter of fact, in a first step of the process—often carried out in a plant physically far from the one where the second step of the process takes place—as a matter of fact the precursor PAN yarn is produced, in plants conceptually derived from those devoted to traditional spinning for weaving purposes, with the introduction of variants to obtain a final yarn having the features best suited for the subsequent carbonisation step. In particular these are high-speed spinning plants, which have fibre outlet speeds up to 150 m/min ("wet spinning" process), up to 500 m/min ("dry jet wet spinning" process) or up to 1000 m/min ("dry spinning" process), the lowest speeds being hence typical of spinning in a solvent bath and the highest ones of dry spinning. The yarn thus produced is wound in bobbins weighing up to 500 kg which are then stored and subsequently sent to the plants where the second step of the process, i.e. the carbonisation one, takes place. Spinning plants of this type normally process a number of tows not above 50, to limit the efficiency reduction of the plant in case of tow breakage, which breakages may require the temporary halting of the entire plant for the repairing thereof.

In the second step of the process the hot treatments on the precursor are instead performed, to obtain the cyclisation, the carbonisation and possibly the graphitisation thereof. Such second step of the process is performed in a plant comprising an initial large-sized creel, whereon the precursor fibre bobbins coming from the spinning plants are installed, downstream of which the oxidation, carbonisation and possibly graphitisation ovens are arranged. Since these thermal treatments require rather long residence times, in order to limit the size of the plant to industrially acceptable limits the processing speed of the carbon fibres in this second step of the process is much lower than in the spinning step, for example ranging between 5 and 20 m/min and the number of simultaneously processed tows is accordingly higher, typically up to 600 tows.

Problem and Solution

The manufacturing process of carbon fibres has been conceived from its very start in the version comprising two separate process steps, and kept in such a version in all its subsequent developments, due to the obvious incompatibility of the speed and flow rate parameters of the two steps of the process. As a matter of fact, considering that a traditional spinning plant can simultaneously produce up to a maximum of 50 tows, it would have been theoretically necessary to flank some 6 spinning lines to directly feed a single carbonisation plant; however, since each traditional spinning line is of a very remarkable size (for example a length up to 100 m), such a solution would have implied the arrangement—evidently unfeasible from a plant engineering point of view—of 6 spinning plants converging into a single feeding of the carbonisation plant.

On the other hand, such a solution would have been also poorly efficient from an economic point of view, since each one of the 6 spinning lines would have had to operate at a very low speed, i.e. identical to the one of the carbonisation step, and hence with a fully inadequate ratio between plant costs and productivity.

The process with two separate steps hence imposed itself as a forced solution, in the light of what has been set forth above, despite the evident technical and economic problems it involves.

A first significant—technical—drawback of the two-step process derives from the bobbin winding of the precursor tows and in particular from the cyclical compression that the tows undergo in this operation by the guiding traverse device, which as a matter of fact causes an uneven oxidation in the subsequent oxidation reaction. A second, equally significant—economic—drawback, is also connected to the winding-on-the-bobbin operations of the precursor tows. As a matter of fact, this operation—and the subsequent relevant operations for storage bobbins, transporting the same to the carbonisation plant and finally inserting the bobbins on the creel feeding such plant—make up an important part of the installation and management costs of a carbon fibre production plant.

A further drawback of traditional spinning lines of the precursor is finally that of the poor flexibility thereof in connection with the production of tows with a lower number of filaments compared to the project one. As a matter of fact, such tows, due to the need of a suitable gap between the same on the respective driving rollers, occupy—the total denier of the spinning line being the same—a larger portion of the roller width than the one occupied by high-denier tows. However, the width of the driving rollers of the tows, for obvious technical and economic reasons, has precise size limits and this size limitation hence implies—the speed and line technology being the same—a dramatic reduction of the manufacturing capability of the same when involved in the production of low-denier tows.

It is hence an object of the present invention to propose a manufacturing process of carbon fibres which is free from these drawbacks and which, in particular, allows to avoid the winding-on-the-bobbin step of the precursor before the carbonisation step, hence guaranteeing the perfect evenness of the tows entering the carbonisation step and eliminating the costs and space occupation concerning the loading/unloading management of the PAN precursor bobbins between the two plants of the traditional 2-step process.

Another object of the present invention is to propose a carbon fibre manufacturing process having high production flexibility even with low denier tows, for example below 1 K, as well as with a low linear density of the filaments, for example below 1 dtex.

Again, a further object of the present invention is to propose a carbon fibre manufacturing process which maintains a high manufacturing efficiency also in the presence of a tow breakage in the spinning step.

All the objects indicated above are achieved through a process having the features defined in the claim 1 herewith enclosed and by a plant having the features defined in claim 8. In the dependent claims additional features of the invention are defined.

BRIEF DESCRIPTION OF THE DRAWINGS

Further features and advantages of the invention will in any case be more evident from the following detailed description of a preferred embodiment of the same, given purely as a non-limiting example and illustrated in the attached drawings, wherein.

DETAILED DESCRIPTION OF THE PREFERRED EMBODIMENT

The object which the inventor set out to achieve with the present invention is to combine the two separate steps of the traditional manufacturing process of carbon fibres in a single in-line process, to thereby obtain a process in which the PAN precursor fibre produced in the spinning section can be supplied directly to the carbonisation section, hence without any type of stocking buffer of PAN precursor fibre between the spinning step and the oxidation/carbonisation step. As a matter of fact, only by achieving this object would it have been possible to fully achieve the main objects of the invention.

The reasons for which this direct combination of the two steps of the traditional process into a single in-line process was neither possible nor conceivable, according to the known art, have already been described in the preliminary portion of this description.

The inventor of the present invention has hence decided to distance himself fully from the traditional approach and has devised a new carbon fibre manufacturing process, characterised, in the spinning step of the PAN precursor fibre, by these fundamental innovative elements:

- a low output-speed in the final stretching step, i.e. a speed which falls within the range of suitable processing speeds in the subsequent oxidation/carbonisation step (currently 5-20 m/min);
- yarn-processing path which develops in a highly compact area, using both horizontal and vertical zig-zag fibre paths;
- modular spinning plant wherein each individual module, which can be joined in series, has a very low productivity (2-8 tows) with respect to the overall process productivity.

Figure 1:
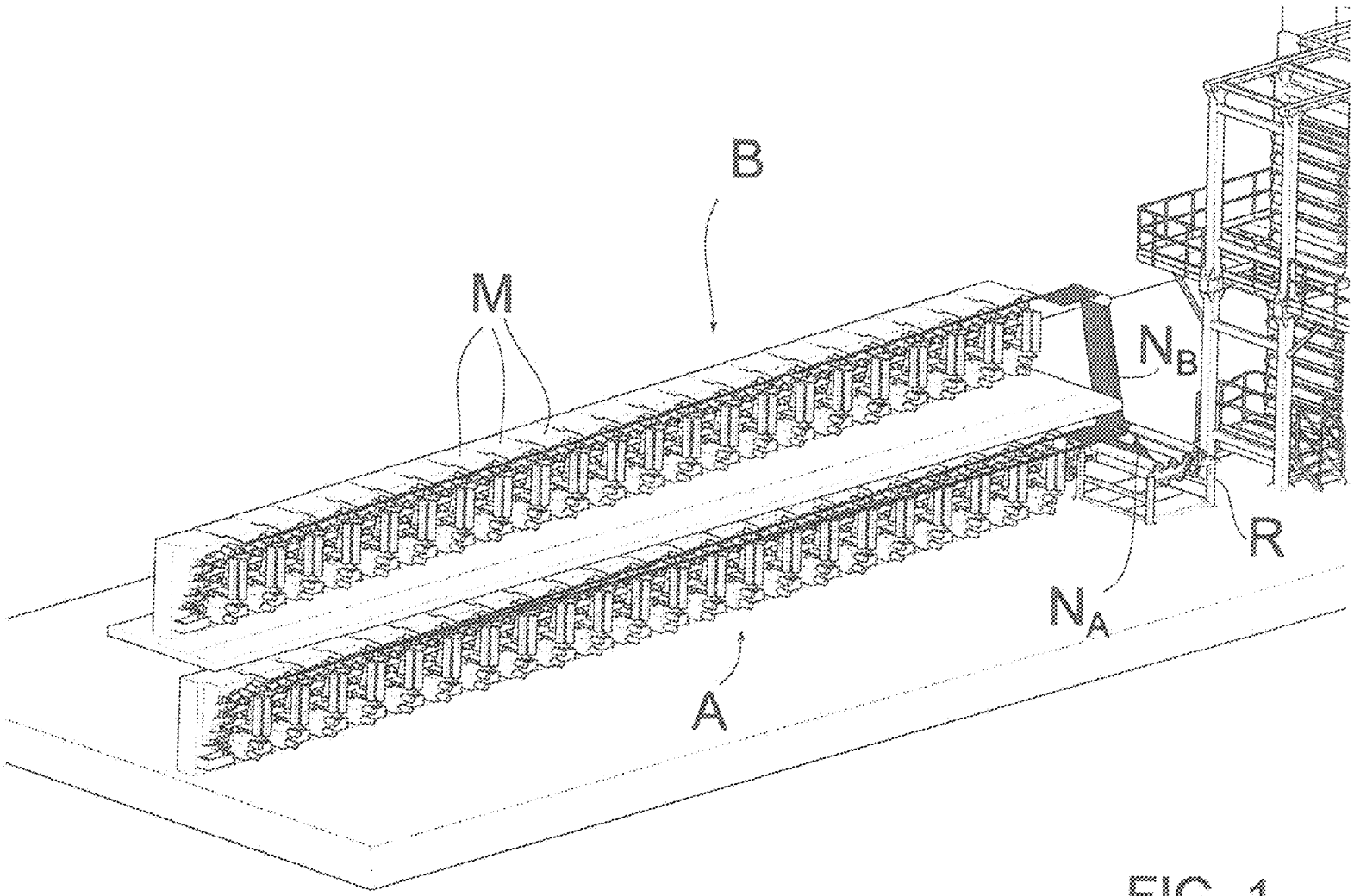
FIG. 1 is a perspective and schematic overall view of the spinning section of a manufacturing plant for carbon fibres according to the present invention.
Figure 2:
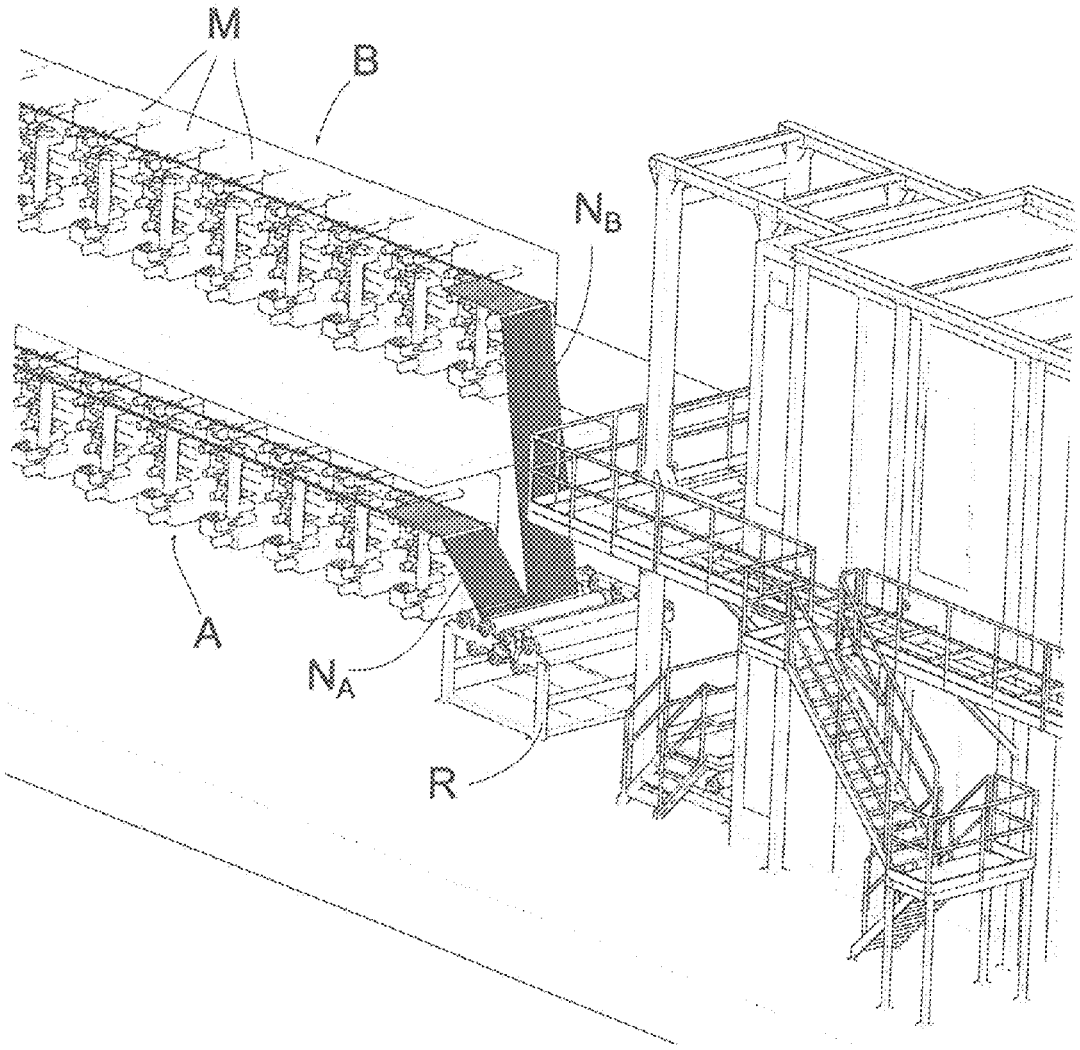
FIG. 2 is a perspective detail view of the end portion of the spinning section of FIG. 1.
Figure 3:
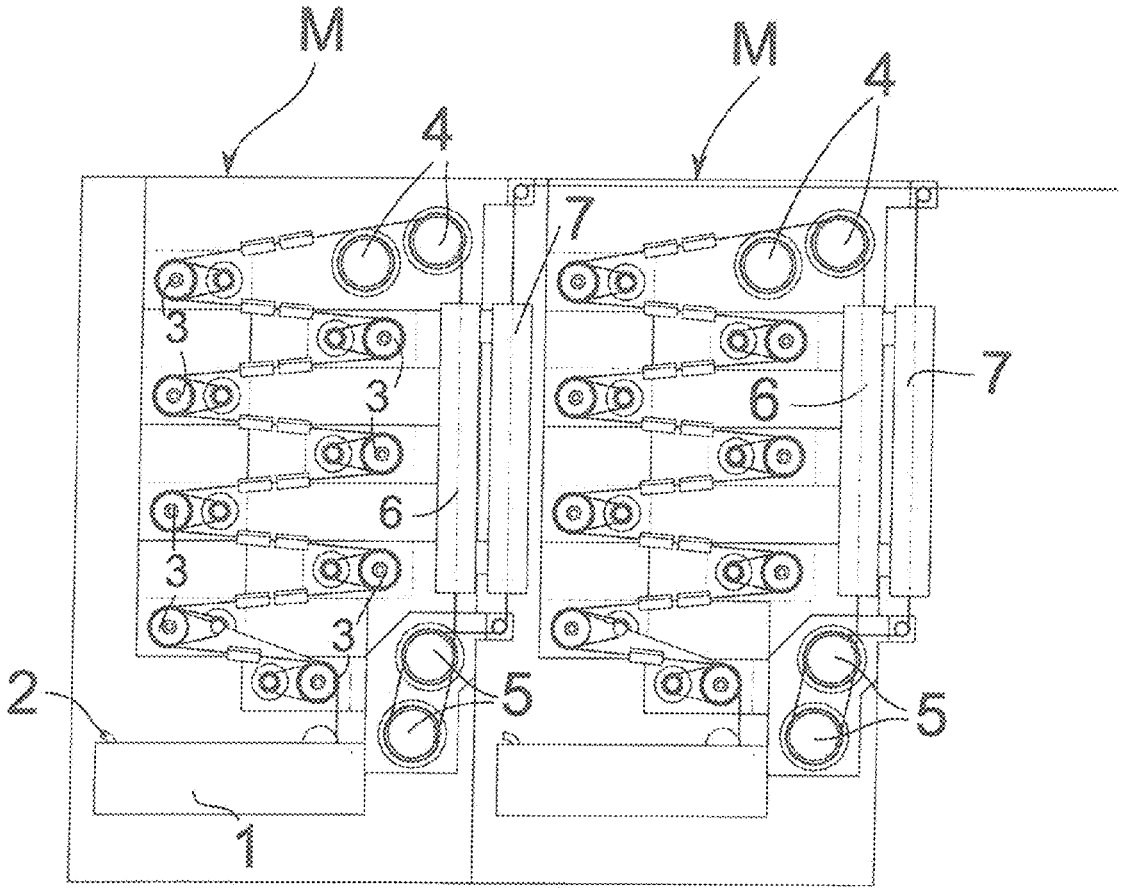
FIG. 3 is a schematic front view which illustrates—in an enlarged scale—two modules of the spinning plant of FIG. 1.
Figure 4:
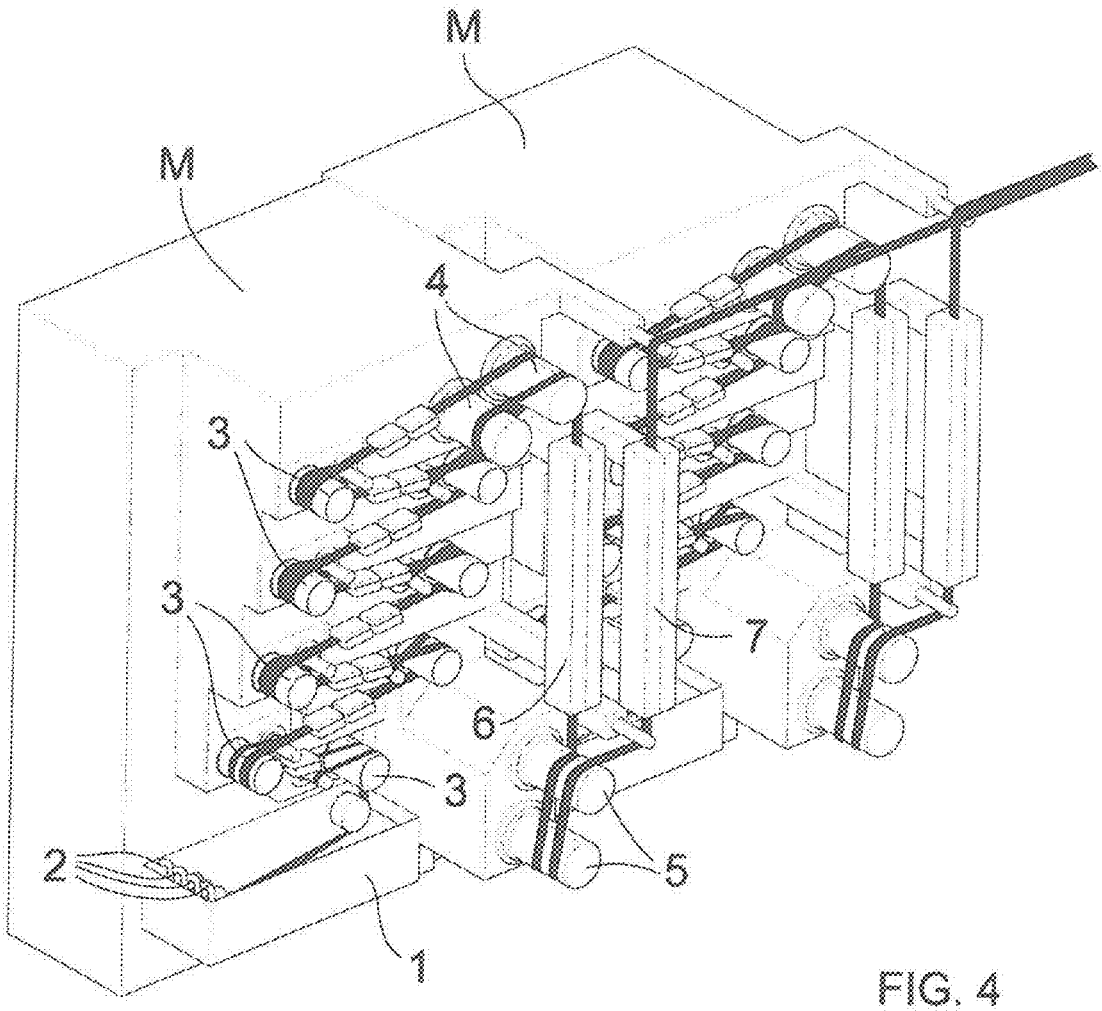
FIG. 4 is an axonometric view of the two modules illustrated in FIG. 3.

An exemplifying diagram of a spinning plant wherein the innovative elements reported above are embodied, and by which the process of the invention can hence be carried out, is illustrated in FIGS. 1 and 2, while the detail of the individual spinning modules is illustrated in FIGS. 3 and 4.

As can be seen in the attached drawings, the illustrated spinning plant, which is an exemplifying, non-limiting embodiment of the present invention, comprises two series of spinning modules, A and B, respectively, arranged one on top of the other and each one consisting of 22 adjacent spinning modules M. Each one of the spinning modules M is for example capable of producing 8 12K tows of PAN precursor.

The overall number of the plant modules M is calculated considering the productivity of each individual module and the requested feeding flow rate of the carbonisation section of the plant. The productivity of each individual module M is preferably below 10% of the overall productivity of the spinning section, more preferably below 5% of such overall productivity and even more preferably below 2.5% of such overall productivity.

According to a particularly interesting feature of the present invention, the individual modules M which make up each one of the series of modules A and B are slightly offset one with respect to the other in a crosswise direction, by an extent corresponding exactly to the overall final width of the tows produced by each module M which, in the example illustrated, is of about 41 mm. Thereby the tows produced by a module can be arranged exactly side by side to the ones produced by subsequent modules M—without imposing any lateral deviation to the same—so as to obtain, at the end of each one of the series of modules A and B, a continuous belt $N_A$, $N_B$ formed by 8×22=176 tows and hence having an overall width of about 900 mm.

The two series of modules A and B are furthermore mutually offset in a crosswise direction precisely by such distance, so that the belt of tows $N_B$, coming out from the series of modules B above, can be arranged side by side to the belt $N_A$, coming out from the series of modules A below, through a suitably arranged drawing roller assembly R—in this case, too, without imposing any crosswise deviation to belts $N_A$ and $N_B$—so as to form a continuous belt of tows having a width of 1800 mm which is a typical belt size used for feeding the subsequent oxidation oven F of the carbonisation section, which section hence remains fully identical to the one of traditional processes. It is important to stress that the complete absence of crosswise deviations imposed on the PAN precursor fibres during the spinning process and hence during the transport process up to the oxidation/carbonisation oven F, allows to avoid any unevenness of the same, which unevenness would inevitably translate into an irregular crystal structure of the carbon fibres derived from said PAN precursor fibres and hence, in the last analysis, into non-optimal mechanical features of the same.

As stated above, the spinning process occurs at a much lower speed than that of traditional plants and, in particular, at such a speed that the belt of tows $N_A$ $N_B$ coming out from the spinning section, i.e. after the stretching operations, has the inlet speed of oxidation section F of traditional plants, i.e. a speed typically ranging between 5 and 20 m/min.

The structure of each individual spinning module M is immediately understandable from FIGS. 3 and 4 which show a preferred embodiment thereof.

In the lower portion of each module M a spinning tank 1 is arranged containing the coagulation bath of the PAN fibre, wherein between 2 and 8 spinnerets 2 are soaked, arranged side by side. The tows formed by the filaments coming out from spinnerets 2 are collected from spinning tank 1 and are hence led into a path which—unlike what occurs in traditional spinning plants—develops both in a horizontal direction and in a vertical direction with a zig-zag path on a series of independently motor-driven rollers 3, 4 and 5. In the illustrated embodiment, 8 rectilinear, sub-horizontal paths are formed between pairs of opposite rollers 3 and along the same paths all the necessary operations, i.e. washing, stretching, drying, stabilising and finishing of the PAN precursor fibres, are performed through a series of devices—known per se by a person skilled in the field and for this reason not described here in detail—through which the fibres being formed are caused to pass, simultaneously subjecting them to the action of different aqueous solutions.

In particular, in the first two rectilinear paths between rollers 3, immediately downstream of spinning tank 1, post-coagulation and pre-stretch treatments are performed, in the four subsequent intermediate paths washing and wet-stretching treatments are performed, while in the two final paths surface finish treatments are performed. At the end of this series of treatments the tows of fibres being formed, which have in the meantime arrived at the top of module M are brought back to the bottom of the same according to a rectilinear vertical path which extends between a first pair of stretching rollers 4 and a second pair of stretching rollers 5; the pair of rollers 4 is heated, so that when passing on the same the fibres are dried and caused to collapse (collapse=fibre density increase, under tension and heat, due to collapsing of the possible alveolar structure of the same generated by solvent removal).

Along the rectilinear path between the pairs of rollers 4 and 5 a steam stretching device 6 is furthermore provided through which the fibres are caused to pass in order to undergo the final stretching determined by the rotation speed difference between the pair of rollers 5 and the pair of rollers 4. From the pair of rollers 5 the tows of PAN fibres are finally brought back to the top portion of module M, in a second, vertical, rectilinear path through a steam annealing device 7, and finally from here they are sent to the oxidation section together with those coming from the preceding or subsequent spinning modules M, of the same series A or B.

Due to the fact that spinning is performed at low speed, the length of the treatment paths can be particularly short, despite maintaining satisfactory permanence times within the individual fibre-processing devices. This allows to limit the overall size of spinning modules M to particularly low values; as an example, in the illustrated embodiment the longitudinal dimension of the modules, or more precisely the pitch between two subsequent modules, is of 1250 mm, while the height of the modules is below 2200 mm.

Since in each one of modules M there is a relatively low production of fibre, the width of rollers 3-5 can be easily dimensioned so as to house—even in the first spinning steps where the fibre bulk is highest—a larger number of lower-denier tows or of tows consisting of filaments having low linear density, so as to be able to keep the overall productivity of each module M constant, regardless of the number of processed tows and of the linear density of the individual filaments making up said tows.

The overall length of a spinning plant according to the present invention is hence about 30 meters, also comprising a drawing roller assembly R which provides to arrange belts $N_A$ and $N_B$ side by side and to feed oxidation section F. Such overall length is not only much shorter than the one of currently used spinning plants, but even comparable to the one of the sole creel feeding traditional carbonisation plants. Using the process and plant according to the present invention it is hence possible to innovate the operation of existing plants at a very low cost and with a dramatic efficiency boost, both in terms of the quality of the finished product and of the cost of the same.

As a matter of fact, it is evident from the detailed description reported above that the carbon fibre manufacturing process according to the present invention fully reaches the set main object, since the step of winding on the bobbin the PAN precursor at the end of the spinning step, is therein fully eliminated. The problems that such winding used to determine are hence cleared, both in terms of tow homogeneity—and hence of the quality of the carbon fibre obtained from said PAN precursor fibres—and in terms of the plant costs and running costs connected to the winding/transport/unwinding of the bobbins of PAN precursor.

The manufacturing process of carbon fibres according to the present invention furthermore allows to achieve also the other additional objects of the invention and, in particular:

- a dramatically improved efficiency in case of tow breakage, since in this case it is not necessary to halt the entire production of the spinning section, as occurs in traditional plants, but only that of the individual module M affected, with a minimal loss of productivity which, for example, in the illustrated embodiment, is equal to about 2.3% of the overall productivity;
- a high process flexibility, i.e. the possibility to produce tows with a low denier or with filaments having low linear density without negative effects on productivity. As a matter of fact, the modularity of the proposed technical solution does not pose a substantial limit to the theoretic overall width of the spinning section, equal to the sum of the widths of the small rollers 3-5 used in each of modules M—whereon the overall denier of the processed fibres can hence be maintained unchanged even working with low-denier tows or with filaments having low linear density—thereby providing spinning lines which are much more efficient than conventional spinning lines, where the maximum width of the rollers represents a limit for line productivity when working with low-denier tows. Moreover, the production of the above said low-denier tows or of tows with filaments having low linear density can be implemented only in a portion of the spinning plant modules M specifically adapted for this purpose, thereby improving plant flexibility also from this point of view.

However, it is understood that the invention must not be considered limited to the particular embodiment illustrated above, which represents only an exemplifying embodiment thereof, but that a number of variants are possible, all within the reach of a person skilled in the field, without departing from the scope of the invention, as defined by the following claims.

The invention claimed is:

1. A process for manufacturing carbon fibres, comprising a first step of spinning a fibre of a PAN precursor, and a second step of oxidation/carbonisation of said fibre, wherein:

a. said spinning and oxidation/carbonisation step is carried out directly in line and continuously, therefore without any stocking buffer area of PAN precursor between said first and second steps;

b. said spinning step is performed at a low speed, so that the outlet speed from the spinning step, downstream of the stretching operations, is a speed falling within a range of suitable processing speeds in the subsequent oxidation/carbonisation step;

c. said spinning step is performed in a modular way on a plurality of spinning modules (M) aligned in one or more rows (A, B), each spinning module (M) having a productivity not above 10% of the overall productivity of the spinning step;

d. in each individual spinning module (M), the fibres downstream of the spinning area follow zig-zag, rectilinear paths through deflection and driving rollers (3-5), both in a horizontal direction and in a vertical direction, along which paths the various spinning treatments are carried out; and e. the fibre tows coming out of each spinning module (M) are arranged side by side with the fibre tows coming out of the preceding modules and/or the following modules (M), the fibre tows not undergoing lateral deviations with respect to the progress direction of the line, to form a single feeding belt (N) of the oxidation/carbonisation step.

2. The process of claim 1, wherein individual modules (M) in each of said rows (A, B) of modules are slightly offset with respect to one another in a crosswise direction, by an amount corresponding to the overall final width of the tows produced by each module (M).

3. The process of claim 2, wherein said rows (A, B) of aligned modules (M) are mutually superposed and each upper row (B) is overall offset in a crosswise direction with respect to the lower row (A), by an amount corresponding to the overall final width of the belt of tows (NA) manufactured in said lower row (A).

4. The process of claim 3, further comprising a drawing roller assembly (R) configured to align on a same plane the belts of tows (NA, NB) manufactured in each of said rows (A, B) of spinning modules (M).

5. The process of claim 4, wherein said outlet speed of the tows from the spinning step, downstream of the stretching operations, is a speed ranging between 5 and 20 m/min.

6. The process of claim 4, wherein the productivity of each spinning module (M) is not above 5% of the overall productivity of the spinning step of the process.

7. The process of claim 4, wherein each spinning module (M) comprises:

a. a tank (1) arranged in a lower portion of the module comprising a coagulation bath of the PAN fibres, in which 2 to 8 spinnerets (2) aligned side by side are soaked;

b. at least six sub-horizontal, rectilinear paths between deflection and driving rollers (3), progressing from the lower portion of the module to an upper portion of the module, along which a post-coagulation treatment, a pre-stretching treatment, three or more washing and wet-stretching treatments, and one or more final surface finishing treatments are respectively performed; and c. two vertical, rectilinear paths between pairs of deflection and driving rollers (4, 5), from the top of the module (M) to the bottom of the module and vice versa, along which a collapsing treatment, a steam stretching treatment, and finally a steam annealing treatment of the tows, are respectively performed.

8. The process of claim 4, wherein the productivity of each spinning module (M) is not above 2.5% of the overall productivity of the spinning step of the process.

* * * * *